US008029318B2

(12) United States Patent
Namiki et al.

(10) Patent No.: US 8,029,318 B2
(45) Date of Patent: Oct. 4, 2011

(54) ELECTRIC POWER PLUG AND METHOD OF PRODUCING THE SAME

(75) Inventors: Kiyoshi Namiki, Kanagawa (JP); Akihiro Yui, Kanagawa (JP)

(73) Assignee: Kawasaki Electric Wire Co., Ltd., Kanagawa (JP)

( * ) Notice: Subject to any disclaimer, the term of this patent is extended or adjusted under 35 U.S.C. 154(b) by 0 days.

(21) Appl. No.: 12/640,916

(22) Filed: Dec. 17, 2009

(65) Prior Publication Data

US 2011/0097943 A1 Apr. 28, 2011

(30) Foreign Application Priority Data

Oct. 20, 2009 (JP) ..... 2009-240948

(51) Int. Cl.
*H01R 13/58* (2006.01)

(52) U.S. Cl. ..... 439/606; 439/106; 439/736

(58) Field of Classification Search ..... 439/60, 439/736, 106, 695, 701, 6
See application file for complete search history.

(56) References Cited

U.S. PATENT DOCUMENTS

| | | | | |
|---|---|---|---|---|
| 2,047,094 | A * | 7/1936 | Bennett | 439/598 |
| 3,093,434 | A * | 6/1963 | Francis | 439/695 |
| 3,609,630 | A * | 9/1971 | Francis | 439/106 |
| 3,611,257 | A * | 10/1971 | Carkhuff | 439/587 |
| 5,176,545 | A * | 1/1993 | Brown | 439/885 |
| 5,378,162 | A * | 1/1995 | Waible | 439/106 |
| 5,411,403 | A * | 5/1995 | Blanche | 439/106 |
| 5,474,459 | A * | 12/1995 | Su | 439/106 |
| 5,603,638 | A * | 2/1997 | Brown et al. | 439/606 |
| 5,662,484 | A * | 9/1997 | Blanche | 439/106 |
| 6,910,920 | B2 * | 6/2005 | Su | 439/606 |
| 6,945,826 | B2 * | 9/2005 | Wise | 439/693 |
| 7,070,460 | B1 * | 7/2006 | Nagano | 439/736 |

FOREIGN PATENT DOCUMENTS

JP 3327093 B2 * 1/2002

* cited by examiner

*Primary Examiner* — Briggitte R Hammond

(74) *Attorney, Agent, or Firm* — Leighton K. Chong

(57) ABSTRACT

An electric power plug comprises blades, a bridge and a plug body. The bridge includes sleeves for covering the roots of the blades and a core for holding the lower ends of the blades. The blades and the core are integrally molded. The plug body is molded so that the plug body embeds the bridge except the upper portions of the sleeves. The core may embed the lower portions of the blades, cords, a caulking portion for connecting the lower ends of blades and wire conductors of the cords. A cavity may be formed at the central portion of the core. The plug body may be molded so that the plug body embeds the bridge and the cords except the upper portions of the sleeves.

2 Claims, 3 Drawing Sheets

ELECTRIC POWER PLUG AND METHOD OF PRODUCING THE SAME

TECHNICAL FIELD

This invention relates to an electric power plug and a method of producing the same, and more particularly an electric power plug provided with tracking resistance and a method of producing the same.

BACKGROUND OF INVENTION

A conventional electric power plug provided with tracking resistance is described in the Japanese Patent 3,327,093. The described electric power plug is of a construction that connecting terminal members or blades are inserted in the thermosetting resin and are connected at its bottom portion to power cords by caulking. The plug body is made of polyvinyl chloride material or the like. The connecting terminal members are provided with gap fillers or sleeves for wrapping or covering the roots of the connecting terminal members. When the resin such as polyvinyl chloride material or the like for making the plug body is injected or inpoured into die assembly, the gap fillers are made simultaneously with the plug body by inflow of the resin through connecting terminal inserting hole.

Since at the conventional power plug the surface of thermosetting resin is exposed to the front surface of the plug body, the thermosetting resin easily gets out of the plug body. In order to prevent the thermosetting resin from getting out of the plug body, the thermosetting resin is required to be provided with a relatively long leg portion which extends into the plug body. Although the gap fillers are made by inflow of the resin through connecting terminal inserting hole when the resin such as polyvinyl chloride material or the like is injected into die assembly, it is very difficult to mold or form a thin gap fillers by that step, and therefore it is believed that it is very difficult to mold a thin gap fillers simultaneously with the perfect molding of plug body.

Therefore, it is an object of the present invention to provide an electric power plug in which sleeves and a core can be integrally molded to prevent the thermosetting resin from getting out of the plug body.

It is the other object of the present invention to provide a method of producing an electric power plug in which sleeves and a core can be integrally molded to prevent the thermosetting resin from getting out of the plug body.

SUMMARY OF INVENTION

To accomplish the object, there is provided an electric power plug which comprises blades, a bridge including sleeves for covering the roots of said blades and a core for holding the lower ends of said blades which are integrally molded, and a plug body molded so that the plug body embeds said bridge except the upper portions of said sleeves.

There is also provided an electric power plug which comprises blades a bridge including sleeves for covering the roots of said blades and a core which are integrally molded, said core embedding the lower portions of said blades, cords, a caulking portion for connecting the lower ends of blades and wire conductors of said cords, and a cavity being formed at the central portion of said core, and a plug body molded so that the plug body embeds said bridge and said cords except the upper portions of said sleeves.

There is also provided a method of producing an electric power plug which comprises steps of integrally molding with hard resin a bridge including sleeves for covering the roots of sleeves and a core for holding the lower ends of said blades, caulking the lowermost ends of said blades and the wire conductors of cords at caulking portion, molding a plug body with soft resin so that said plug body embeds said bridge, said caulking portion and said cord at said caulking portion except the upper portion of said sleeves.

There is also provided a method of producing an electric power plug which comprises steps of caulking the lower ends of blades and the wire conductors of cords, integrally molding a bridge with hard resin, said bridge including sleeves for covering the roots of said blades and a core, said core embedding the lower portions of said blades, cords, a caulking portion for connecting the lower ends of blades and wire conductors of said cords, and a cavity being formed at the central portion of said core, and molding a plug body with soft resin so that said plug body embeds said bridge and said cord except the upper portion of said sleeves.

Other objects, features, and advantages of the present invention will be explained in the following detailed description of the invention having reference to the appended drawings:

BRIEF DESCRIPTION OF DRAWINGS

FIG. 1 is a view showing a first embodiment of an electric power plug according to the present invention, FIG. 2 is a view showing a second embodiment of an electric power plug according to the present invention, FIG. 3 is a view for explaining about main steps of producing the second embodiment of an electric power plug according to the present invention.

DETAILED DESCRIPTION OF THE INVENTION

First Embodiment

Figure 1A:
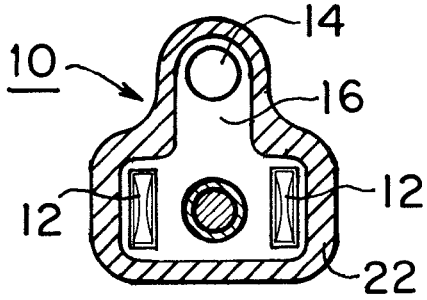
FIG. 1A is its plan view showing the power plug.
Figure 1B:
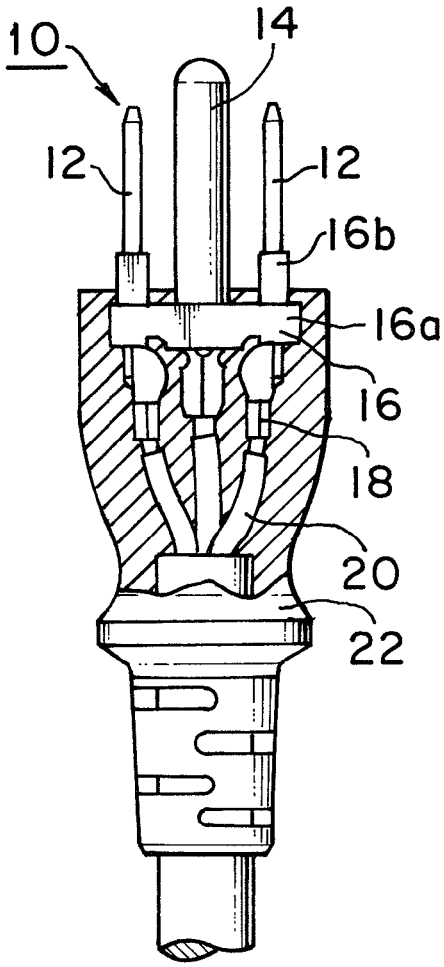
FIG. 1B is its cross-sectional view of the power plug at one side.
Figure 1C:
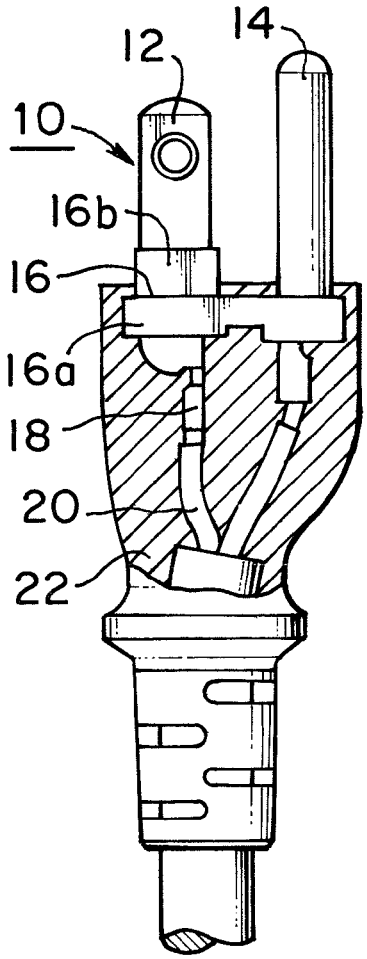
FIG. 1C is its cross-sectional view at the other side.
Figure 2A:
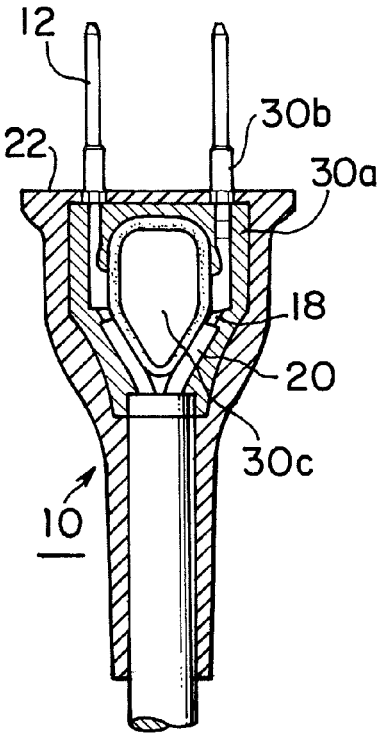
FIG. 2A is a cross-sectional view of the power plug seen from the front side.
Figure 2D:
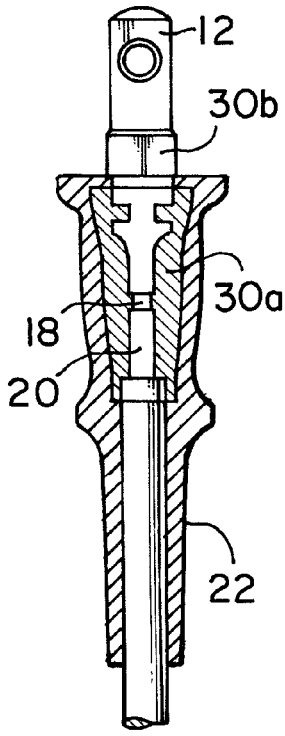
FIG. 2D is its cross-sectional view seen from one side.
Figure 2E:
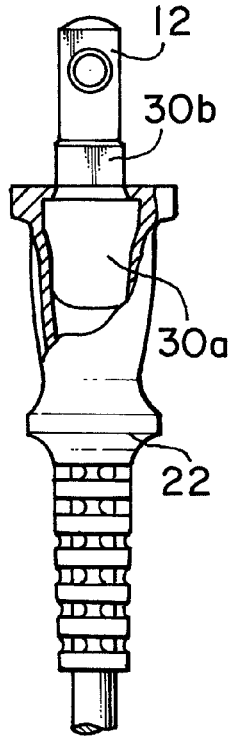
FIG. 2E is its side view partially broken away.
Figure 2B:
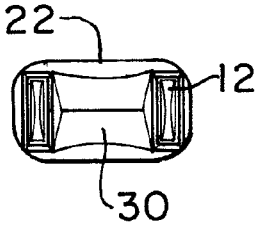
FIG. 2B is its plan view of the power plug.
Figure 2C:
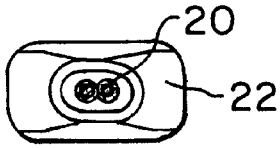
FIG. 2C is its bottom view of the power plug.

Now referring to FIG. 1, blades 12 are covered by sleeves 16*b* injection molded with hard thermosetting resin for imparting tracking resistance to the roots of the blades. These sleeves 16*b* are integrally molded or formed with a core 16*a* which holds the bottom ends of the blades 12 and the bottom end of an earth pin 14. For convenience of explanation, The assembly of integrally molded sleeves 16*b* and core 16*a* is hereinafter referred to as a bridge 16. The power plug which is not provided with the earth pin is applicable to the present invention, as shown in FIGS. 2 and 3.

The blades 12 and the earth pin are provided with caulking portions 18 at their bottommost ends, and are caulked or pressure connected to the wire conductors of the cords 20 at the caulking portions 18. The plug body 22 is injection molded with soft resin such as soft polyvinyl chloride, soft polyethylene resin, soft polyolefin resin or the like so as to embed the bridge 16, caulking portions 18 and cords 20 except the upper portions of sleeves 16*b*. Since the bridge 16 is embedded within the plug body 22, it cannot get out of the plug body 22. Furthermore, since the sleeves 16*b* are molded without thermosetting resin being flowed in through connecting terminal inserting hole, the sleeves are molded almost perfectly.

Second Embodiment

In FIG. 2, the blades 12 are covered by sleeves 30*b* injection molded with hard thermosetting resin for imparting tracking resistance to the root of the blades. These sleeves 30*b* are integrally molded or formed with a core 30*a*. The core 30*a* is injection molded with thermosetting resin so as to form a cavity 30*c* at its central portion, and to embed the core 30*a*, the lower portions of the blades 12, the cords 20, and the caulking portions 18 where the blades 12 and the wire conductors of the cords 20 are caulked. For convenience of explanation, The assembly of integrally molded sleeves 30*b* and core 30*a* is hereinafter referred to as a bridge 30.

The plug body 22 is injection molded with soft resin such as soft polyvinyl chloride, soft polyethylene resin, soft polyolefin resin or the like so as to embed the bridge 30 and the cords 20 except the upper portions of sleeves 30*b*. Since the bridge 30 (except the upper portions of the sleeves) is embedded within the plug body 22, it cannot get out of the plug body 22. Furthermore, since the sleeves 30*b* are molded without thermosetting resin being flowed in through connecting terminal inserting hole, the sleeves are molded almost perfectly.

Figure 3A:
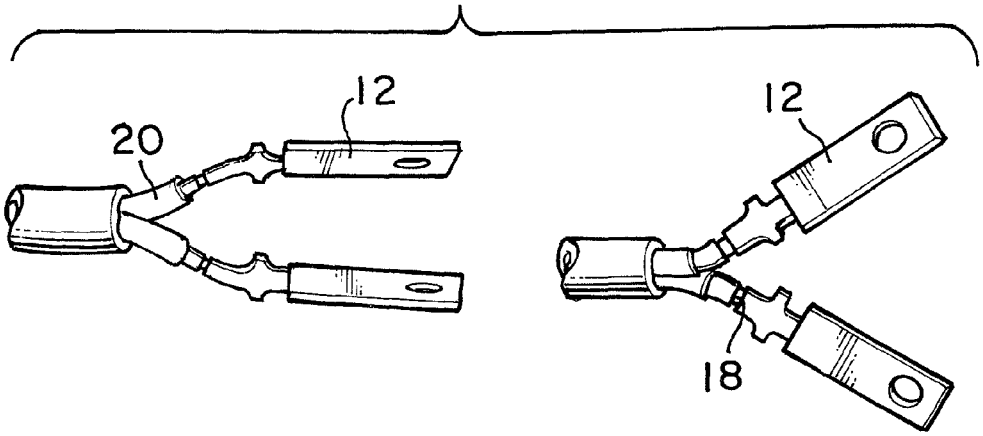
FIG. 3A shows caulking state of plug blades and cords.
Figure 3B:
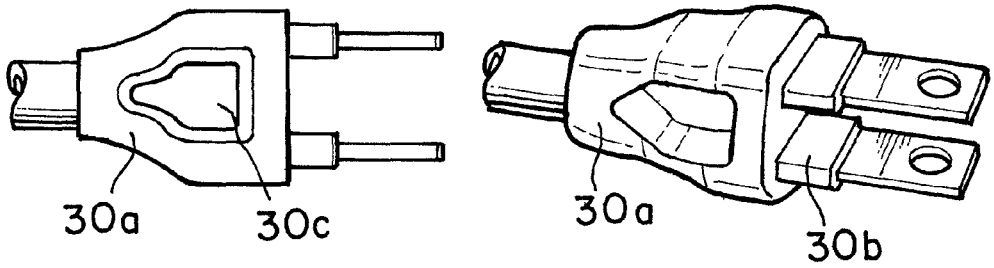
FIG. 3B shows a core injection molded with hard thermosetting resin so as to cover plug blades and cords.

Now main steps of production of power plug will be explained with reference to FIG. 3. In FIG. 3A, as a first step the blades 12 and the wire conductors of cords 20 are connected to each other by caulking. The caulked product of the blades 12 and cords 20 is disposed within die assembly, not shown. Thereafter, as shown in FIG. 3B, the bridge 30 comprising core 30*a* and sleeves 30*b* is injection molded with thermosetting resin so that the cavity 30*c* is formed at the central portion of the bridge, and the lower portion of the blades 12, the cords 20 and the caulking portions 18 are embedded within the bridge. Finally, The plug body 22 is injection molded with soft resin so as to embed the bridge 30 within the plug body 22 except the upper portions of sleeves 30*b*.

The second embodiment has the following advantages over the first embodiment:

(1) Since in the first embodiment caulking portions are molded integrally with plug body made of soft resin, in the unlikely event that wire conductors get out of caulking portions, one or a few wire conductors are exposed to the surface of plug body, which would result in electric shock accident. Even if one or a few wire conductors are not exposed to the surface of plug body, insulation distance between the wire conductors and the surface of plug body would become remarkably short.

Meanwhile in the second invention even if the wire conductors get out of caulking portions, since insulation distance is maintained by the outside plug body made of soft resin insulator, electric shock accident or lowering of insulation distance does not occur.

(2) Since in the first embodiment the cords are fixed at its outer surface to soft resin, when strong force is applied to the caulking portions by strong tensile force applied to the cords, overload would be applied to wire conductors.

Meanwhile in the second embodiment the cords are fixed to the core by injection molding pressure and the cords and the core are injection molded integrally with soft resin, durability for tensile force is enhanced several times.

(3) In the first embodiment, air bubbles due to gases generated at the time of molding stay within the core.

Meanwhile in the second embodiment since the cavity or opening is formed at the central portion of the core, gas retention is suppressed, and since the thick portion of the core does not exist, the gases easily flow out.

It is understood that many modifications and variations may be devised given the above description of the principles of the invention. It is intended that all such modifications and variations be considered as within the spirit and scope of this invention, as it is defined in the following claims.

The invention claimed is:

1. An electric power plug which comprises blades, each of which has a root and a lower end, a bridge including sleeves, each of which has an upper portion, for covering the roots of said blades and a core for holding the lower ends of said blades, said sleeves and said core being integrally molded, and a plug body molded so that the plug body embeds said bridge except the upper portions of said sleeves.

2. An electric power plug which comprises blades, each of which has a root, a lower end and an upper portion, a bridge including sleeves, each of which has an upper portion, for covering the roots of said blades and a core, which has a central portion, said sleeves and said core being integrally molded, said core embedding the lower portions of said blades, cords, a caulking portion for connecting the lower ends of blades and wire conductors of said cords, and a cavity being formed at the central portion of said core, and a plug body molded so that the plug body embeds said bridge and said cords except the upper portions of said sleeves.

* * * * *